United States Patent [19]

Hoskinson et al.

[11] Patent Number: 4,871,140

[45] Date of Patent: Oct. 3, 1989

[54] HANGING DEVICE

[75] Inventors: Marlin J. Hoskinson, Philadelphia, Pa.; Eugene M. Lorincz, Cinnaminson, N.J.; George W. Samson, Blue Bell, Pa.

[73] Assignee: Moore Push-Pin Company, Wyndmoor, Pa.

[21] Appl. No.: 196,675

[22] Filed: May 20, 1988

[51] Int. Cl.[4] ..... A47G 1/16

[52] U.S. Cl. ..... 248/496; 248/497; 248/477; 248/216.1

[58] Field of Search ..... 248/495, 496, 497, 489, 248/490, 477, 216.1

[56] References Cited

U.S. PATENT DOCUMENTS

| | | | |
|---|---|---|---|
| D. 203,538 | 1/1966 | DiNuccio . | |
| D. 208,580 | 9/1967 | Margulis . | |
| D. 227,976 | 7/1973 | Barth . | |
| D. 241,711 | 10/1976 | Wallace . | |
| 814,163 | 3/1906 | Pursell . | |
| 999,961 | 8/1911 | Colas | 248/496 X |
| 1,314,548 | 9/1919 | Taylor | 248/216.1 X |
| 1,600,919 | 9/1926 | Baalsrud . | |
| 1,616,957 | 2/1927 | Honigbaum . | |
| 2,099,332 | 11/1937 | DiNuccio | 248/498 |
| 2,448,137 | 8/1948 | Cody . | |
| 2,448,588 | 9/1948 | Greenberg | 248/495 |
| 2,483,114 | 9/1949 | Van Schoor | 248/496 |
| 2,877,972 | 3/1959 | Sutton . | |
| 3,031,159 | 4/1962 | Waller . | |
| 3,218,747 | 11/1965 | Cornfield | 248/496 X |
| 3,219,302 | 11/1965 | Smith . | |
| 3,298,651 | 1/1967 | Passer . | |
| 3,536,287 | 10/1970 | Kramer . | |
| 3,556,459 | 1/1971 | Summerville . | |
| 3,966,157 | 6/1976 | Corral . | |
| 4,300,745 | 11/1981 | Peterson . | |
| 4,301,986 | 11/1981 | Morel . | |
| 4,509,713 | 4/1985 | Hogg . | |
| 4,515,338 | 5/1985 | Schneider | 248/496 X |
| 4,613,108 | 9/1986 | Sundström . | |
| 4,619,430 | 10/1986 | Hogg . | |
| 4,664,350 | 5/1987 | Dodds . | |

FOREIGN PATENT DOCUMENTS

| | | | |
|---|---|---|---|
| 48394 | 2/1934 | Denmark | 248/496 |
| 226253 | 2/1910 | Fed. Rep. of Germany | 248/497 |
| 63317 | 2/1929 | Switzerland | 248/497 |

OTHER PUBLICATIONS

Moore Push-Pin Catalog, "Brass Plated Molding Hook", 4–1984.

Figra, "For a New Method of Picture Hanging".

*Primary Examiner*—Alvin C. Chin-Shue

*Attorney, Agent, or Firm*—William H. Eilberg

[57] ABSTRACT

A hanging device facilitates the attachment of a foam board, or an equivalent object, to a wall. The hanging device has a body portion and at least one prong. The method of attaching the hanging device to the foam board includes the steps of inserting the prong upwardly into the foam board, and then rotating the body portion, which remains outside the foam board, so that at least part of the foam is compressed by the prong. If the foam board has a paper skin or backing, insertion of the prong creates a slot in the skin, and the slot tends to hold the device in position. The part of the body portion remaining outside the foam board can be suspended from a mounting device, such as a nail or a conventional picture hanger, affixed to a wall. The prong itself can also be bent towards the body portion, to increase the compression of the foam. In an alternative embodiment, the body portion includes a unique sawtooth structure which permits the same hanging device to be suspended from a variety of different items, such as a nail, a screw, or a conventional picture hanger.

1 Claim, 2 Drawing Sheets

HANGING DEVICE

BACKGROUND OF THE INVENTION

This invention relates to the field of hanging devices, and, in particular, includes a hanging device which is especially suitable for hanging a foam board, or similar article, from a wall.

The prior art contains many examples of picture hanging devices and the like. Several examples are shown in U.S. Pat. Nos. 814,163, 3,298,651, 3,556,459, 3,966,157, 4,509,713, 4,613,108, and 4,664,350.

Foam boards have become popular for the mounting of pictures. It is common to attach pictures, plaques, and the like, to a foam board, or to a structure made of an equivalent compressible material. The present invention includes a hanging device which is particularly intended for suspending such a foam board from a nail or picture hanger. The invention also includes a method of affixing the hanging device to the foam board.

One disadvantage of picture hangers of the prior art is that they are generally suitable for use with only one kind of mounting means. For example, U.S. Pat. Nos. 814,163 and 3,556,459 show hanging devices with a body portion having a sawtooth structure. The sawtooth structure is convenient for suspending the hanging device from a nail driven into a wall, but it is not designed to mesh with the rectangular prong of a conventional metal picture hanger. Also, if the sawtooth spacing is too small, the device may be limited to use with relatively thin nails.

The present invention also solves the problem described above, but providing a picture hanging device having a modified sawtooth pattern, wherein the same device can easily be suspended from different types of picture mounting means, such as nails or conventional picture hangers, without compromising security and stability.

SUMMARY OF THE INVENTION

The present invention is a hanging device for a foam board, and a method of attaching the hanging device to the foam board. The invention also includes a modified sawtooth structure which enables the hanging device to be suspended from a variety of types of hangers embedded in a wall.

In one embodiment, the hanging device includes a body portion and at least one prong attached to the body portion. The body portion has two segments, making an obtuse angle with each other, the segment nearer the prong forming an acute angle with the prong. When the hanging device is in use, the prong points towards the upper end of the foam board. The body portion includes means for suspending the hanging device from a nail, from a conventional picture hanger, or from an equivalent mounting device affixed to a wall. This suspending means can be a set of serrations (a "sawtooth" pattern), or a hole through which the nail or hanger can be inserted.

In the preferred embodiment, there are two prongs. The prongs can be generally straight, or they can be bent or segmented, like the body portion.

The method of inserting the hanging device into the foam board includes the steps of piercing the skin of the board with the prongs, and then forcing the prongs generally upward, into the foam, while the body portion remains outside the foam board. One then rotates the body portion, in a direction such that the tips of the prongs, now within the foam board, tend to move towards the skin of the board. Thus, rotation of the body portion tends to compress a portion of the foam between the prongs and the body portion. Also, insertion of the prong into the skin of the foam board creates a slot which tends to trap the hanging device. The skin therefore tends to prevent relative movement, especially relative vertical movement, of the hanging device and the foam board.

One can make the hanging device according to several alternative embodiments. The body portion can include a hole, either circular or rectangular, making it possible to suspend the hanging device from a nail. One can also provide serrations within the hole, or on the bottom of the body portion, if there is no hole. In still another embodiment, the entire hanging device is formed of a stiff wire member, the ends of the wire member defining the prongs for insertion into the foam board.

The invention also includes a unique sawtooth structure which enables the handling device to be suspended from a variety of wall mounting means. The sawtooth structure includes one or more generally triangular indentations, and one or more rectangular recesses superimposed on the indentations. Each triangular indentation can fit over a thin nail, and each rectangular recess can mate with the rectangular prong of a conventional picture hanger. The combination of the indentation and the recess also provides means for suspending the hanging device from a round-headed screw.

It is therefore an object of the present invention to provide a hanging device for suspending a foam board, or other compressible object, from a wall.

It is another object to provide a method of hanging a foam board, or its equivalent, from a wall.

It is another object to provide a variety of alternative structures which can be used in practicing the above method.

It is another object to provide a hanging device for a foam board, wherein the hanging device is trapped within a slot in the skin of the foam board.

It is another object to provide a hanging device which can be easily and securely suspended from several different kinds of objects affixed to a wall, including nails, picture hangers, screws, and the like.

It is another object to enhance the versatility of picture hanging devices.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 3*b* is taken along the line 3*b*–3*b* of FIG. 2.

FIG. 9 shows the hanging device of FIG. 10 being suspended from a conventional picture hanger affixed to a wall.

FIG. 10 shows the hanging device of FIG. 9, the view of FIG. 10 being taken along the line 10—10 of FIG. 9.

FIG. 11 is a view similar to FIG. 10, showing a hanging device having a modified sawtooth structure with three repeating units.

DETAILED DESCRIPTION OF THE INVENTION

The present invention is a hanging device, especially suited for use with a foam board, but also usable with other objects. The device of the present invention is fastened to the object to be suspended from a wall, and the device itself is then suspended from a mounting means, such as a nail, a screw, or a conventional picture hanger, the mounting means being affixed to the wall. As used in this specification, the term "hanging device" means the structure which is affixed to the picture or other object being hung, and the term "mounting means" designates the nail or other structure which is driven into the wall, from which the hanging device is suspended.

Figure 1:
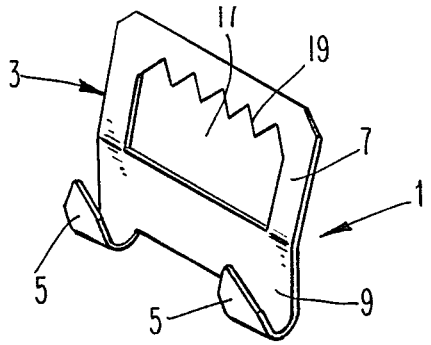
FIG. 1 is a perspective view of one embodiment of the hanging device made according to the present invention.
Figure 2:
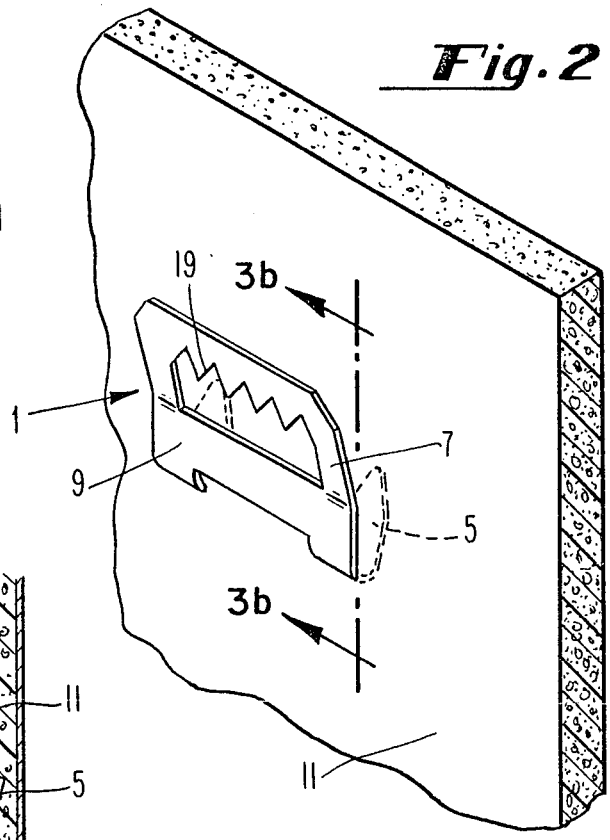
FIG. 2 is a perspective view, showing the hanging device of FIG. 1 inserted into a foam board.
Figure 3A:
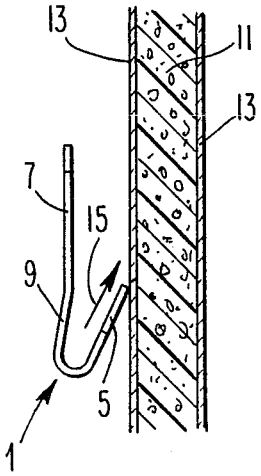
FIGS. 3*a* and 3*b* are cross-sectional views showing the insertion of the hanging device of FIG. 2 into a foam board.
Figure 3B:
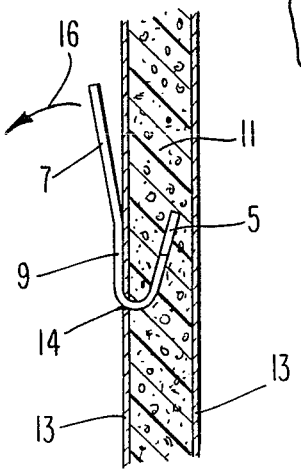

FIG. 1 shows a perspective view of a hanging device made according to one embodiment of the present invention, and FIG. 2 and FIGS. 3*a* and 3*b* illustrate the insertion of the hanging device into a foam board. Hanging device 1 includes body portion 3 and a pair of prongs 5, attached to the body portion. The prongs are preferably integral with the body portion, but they can be separately formed and suitably joined.

As is shown more clearly in FIGS. 3*a* and 3*b*, body portion 3 is segmented, and comprises upper segment 7 and lower segment 9. In the embodiment of FIGS. 1–3, the prong is generally straight. Lower segment 9 forms an acute angle with prong 5, and forms an obtuse angle with upper segment 7. It is possible to form the hanging device with one, two, or more prongs, and it is understood that the reference to the prong in the singular includes the case of plural prongs. When two or more prongs are used, they should be generally parallel to each other, as illustrated in the figures.

Hanging device 1 is inserted into foam board 11, as shown in FIGS. 2, 3*a*, and 3*b*. The foam board includes a paper skin 13. Although the term "foam board" is used throughout this specification, it is understood that the invention can be used with virtually any other compressible or corrugated materials. Also, the skin of the foam board need not be made of paper, but can be formed of other substances.

As shown in FIG. 3*a*, hanging device 1 is inserted into foam board 11 by directing prong 5 upward into the board, as shown by arrow 15. The prong thus pierces skin 13 and enters the interior of the foam board. The device is then rotated, in the direction indicated by arrow 16, so that the prong compresses at least a portion of the foam. This rotation of the hanging device is also apparent from a comparison of FIGS. 3*a* and 3*b*. Note that, in FIG. 3*a*, lower segment 9 of body portion 3 is not parallel to the surface of the foam board, and that in FIG. 3*b*, the lower segment is parallel to, and rests upon, that surface. It is because segments 7 and 9 are not parallel to each other that segment 7 projects from the foam board, when the hanging device is inserted. Segment 7 includes the means for suspending the device from a nail, or other hanger, affixed to the wall.

FIG. 3*b* also shows slot 14, formed in skin 13, and created by the insertion of the prong. The slot tends to trap the hanging device, and to prevent relative movement, especially relative vertical movement, of the device and the foam board. Although the preferred foam board has a skin, it is understood that the invention can also work with foam boards, or their equivalents, which do not have a skin.

In the device shown in FIGS. 1–3, the means for suspending the hanging device includes hole 17 and serrations 19 formed in body portion 3. The device can be simply inserted over a nail, and the serrations aid in locating the device on the nail.

Figure 4:
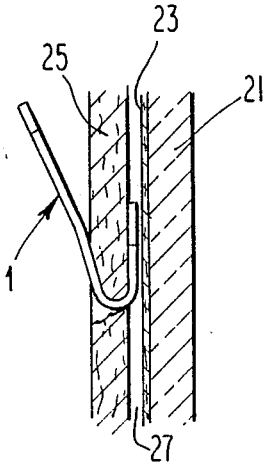
FIG. 4 is a cross-sectional view, similar to FIG. 3*b*, showing a hanging device of the present invention being used to hang a picture having a cardboard backing.

FIG. 4 shows the hanging device of FIGS. 1–3 as used in a somewhat different application, namely hanging a framed picture having a cardboard or other soft backing. FIG. 4 shows a picture 23 mounted under glass 21, and covered at the rear by cardboard 25. Hanging device 1 is inserted in substantially the same way as for the foam board. The prongs of the device rest within the space 27 between the cardboard and the picture. As in the case of the foam board, the cardboard is compressed between the prongs and the lower segment of the body portion of the hanging device.

Figure 5:
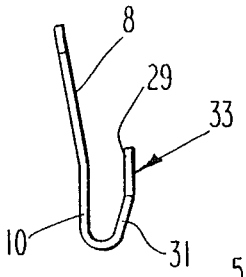
FIG. 5 shows an end view of an alternative embodiment of the hanging device of the present invention, wherein the prong portion is bent inward.

FIG. 5 shows an alternative embodiment of the hanging device of FIGS. 1–4. The body portion of the device of FIG. 5 has upper segment 8 and lower segment 10, as before. But prong 33 itself is segmented, so as to bend inward. FIG. 5 shows tip segment 29 and base segment 31 of the prong. This additional bend in the prong ehances the compressive effect on the foam.

Figure 6:
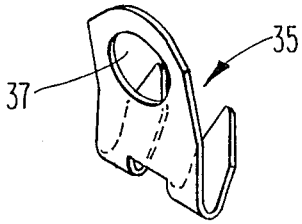
FIG. 6 is a perspective view of an alternative embodiment of the hanging device, wherein its body portion includes a hole for attachment to a nail.

FIG. 6 is a perspective view of an alternative construction of the hanging device. Hanging device 35 has a body portion and a pair of prongs, each being shaped similarly to the prongs described above. However, the body portion of device 35 has a circular hole 37, for engagement of the device with a nail. Hanging device 35 is used in substantially the same way as the hanging devices described above.

Figure 7:
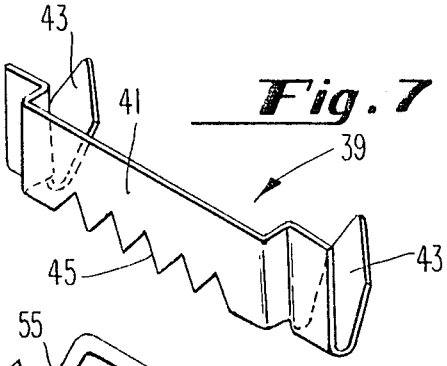
FIG. 7 is a perspective view of another alternative embodiment of the hanging device.

FIG. 7 is a perspective view of another alternative construction of the hanging device. Device 39 has a body portion 41, the body portion being connected to prongs 43. The lower side of the body portion has serrations 45 for suspending the hanging device on a nail. The body portion of device 39 is not segment, like the embodiments described above, because the body portion is already spaced apart from the surface of the board, and can thus engage a nail. But it is understood that a segmented body structure can also be used.

Figure 8:
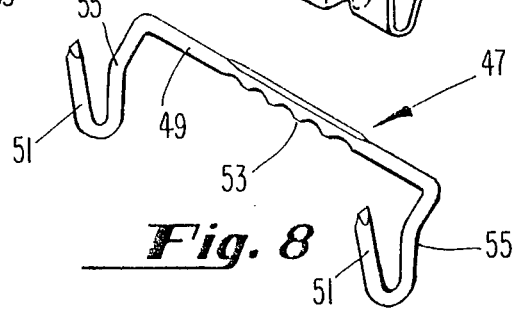
FIG. 8 is a perspective view of another alternative embodiment of the hanging device, wherein the device is formed of a wire.

FIG. 8 shows still another alternative embodiment of the hanging device of the present invention. Hanging device 47 is formed from stiff wire 49, which terminates in prongs 51. Serrations 53 are formed in the central area of the wire. The prongs are connected to the main body of the wire by segmented members 55. Device 47 can thus be used in substantially the same manner as described with respect to the other embodiments.

Figure 10:
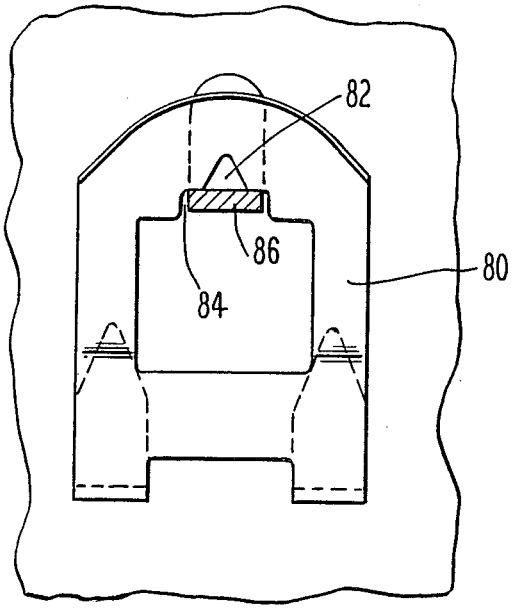
FIGS. 9–11 show a picture hanger hanging a modified sawtooth structure, according to the present invention.
Figure 9:
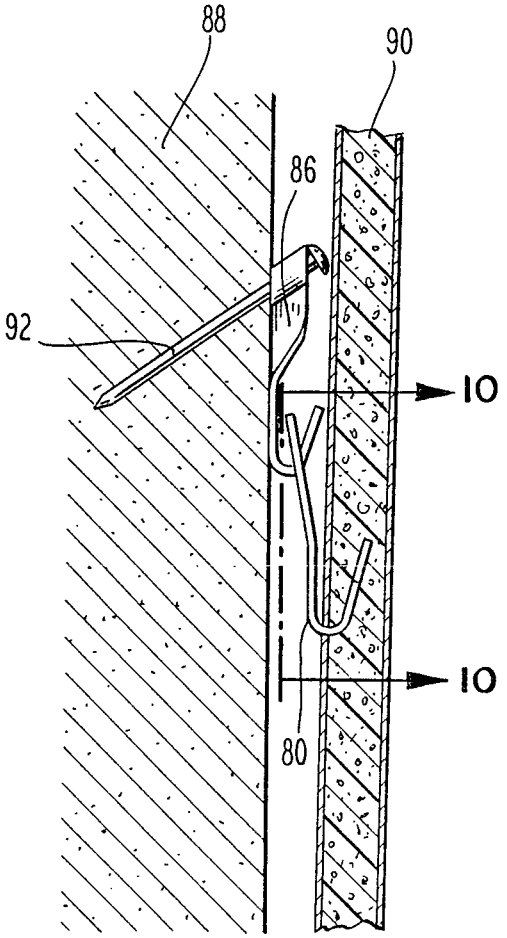
Figure 11:
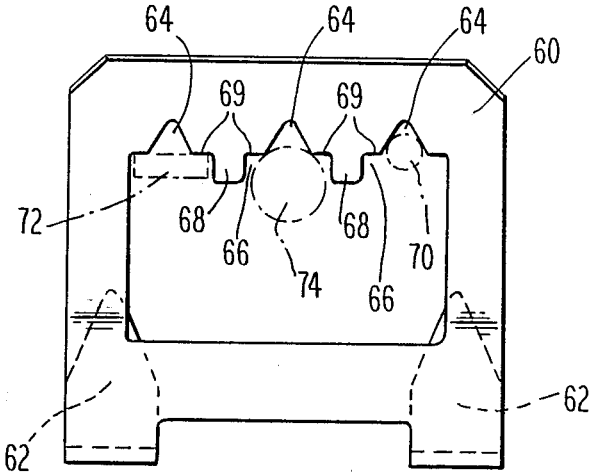

FIGS. 9-11 illustrate an embodiment of the invention which can be used with or without the above-described method of attaching a hanging device to a foam board. FIG. 11 shows hanging device 60, having prongs 62, similar to the prongs discussed above. The device includes a modified sawtooth structure, which has a plurality of triangular indentations 64 and rectangular recesses 66. The rectangular recesses are defined partly by protrusions 68, and partly by horizontal portions 69 of the body of the device. In effect, the recesses are superimposed on the indentations, so that each recess is located in essentially the same position as its associated indentation.

The triangular indentations are capable of being suspended from a relatively thin nail, or its equivalent. The nail is shown in phantom and designated by reference numeral 70. The rectangular recesses are capable of receiving the rectangular portion of a conventional picture hanger, the latter also being shown in phantom and designated by reference numeral 72. One can also suspend the device on a round-headed screw, designated by reference numeral 74. The screw is centered over the indentation, and is flanked by protrusions 68.

FIGS. 9 and 10 show hanging device 80, which is similar to that of FIG. 11, except that there is only one triangular indentation 82 and one rectangular recess 84. As in FIG. 11, the recess and indentation are superimposed, so that the hanging device can be suspended from either a nail, a screw, or a conventional picture hanger, at the same location. FIGS. 9 and 10 explicitly show conventional picture hanger 86, which is fastened to wall 88 by nail 92. Foam board 90 can thus be suspended from the conventional picture hanger, by means of the hanging device described. It is understood that the arrangement shown in FIG. 9 can be practiced with the embodiment of FIG. 11. Also, the number of indentations and recesses can be varied considerably.

Thus, the hanging device shown in FIGS. 9–11 can be suspended from a variety of different types of mounting means, such as conventional picture hangers, nails, or screws. It will also be appreciated that the modified sawtooth structure shown in FIGS. 10 and 11 can be used with conventional hangers, without regard to a foam board. Thus, the modified sawtooth structure can replace the general-purpose sawtooth arrangements of U.S. Pat. Nos. 814,163 and 3,556,459, discussed above, and could be used for hanging virtually any picture from a wall.

The hanging device of the present invention can be made of any reasonably stiff material. For example, the device can be formed of metal, such as steel strapping which has been painted and waxed, Other materials can be used. It is necessary only that, if the device is used with a foam board, the material be sufficiently stiff to permit the prong to pierce the skin and the foam, and to compress the foam upon rotation.

Although the method of insertion of the hanging device has been described mainly with respect to a foam board, it is understood that this method can be practiced with other compressible materials, such as the picture backing board described above, and with graphics art boards, corrugated paper, and corrugated plastic. The device can also be inserted directly into compressible wood, such as balsa wood. All of these materials are sufficiently pliable to be compressed by the prongs of the hanging device.

The above disclosure also shows that many different styles of hanging device bodies are possible, within the scope of the present invention. The prongs can also be varied, in number and in shape. Thus, it is possible to make many hanging devices, which differ greatly in outward appearance, all of which operate according to the same principle. All such modified devices should be deemed within the spirit and scope of the following claims.

What is claimed is:

1. In combination, a foam board and a hanging device, the foam board having upper and lower ends, the hanging device having a body and at least one prong, the prong being inserted into the foam board and being oriented towards the upper end of the board, the body of the hanging device being located outside of the foam board, the body extending generally towards the upper end of the board, wherein the body comprises means for suspending the foam board from a mounting means, wherein at least part of the foam in the foam board is compressed by the prong, and wherein the body of the hanging device includes a plurality of generally triangular indentations, the indentations being spaced apart from each other, and a plurality of generally rectangular recesses, the indentations and recesses being superimposed on each other, wherein the device can be suspended from either a rectangular member or a nail, at the same position on the device, and wherein the recesses are defined, in part, by protrusions, having parallel vertical walls, located between pairs of recesses, and horizontal walls adjoining the upper ends of said vertical walls, said body of the hanging device including two segments, one of the segments being nearer to the prong and being designated as the lower segment, and the other segment being designated as the upper segment, wherein the upper and lower segments form an obtuse angle with respect to each other, and wherein the lower segment is non-parallel with the prong, and forms an acute angle with the prong.

* * * * *